United States Patent [19]

Mackey et al.

[11] 4,275,147

[45] Jun. 23, 1981

[54] ANTISTATIC PHOTOGRAPHIC ELEMENT

[75] Inventors: E. Scudder Mackey; Karl Pechmann, both of Binghamton, N.Y.

[73] Assignee: GAF Corporation, New York, N.Y.

[21] Appl. No.: 167,591

[22] Filed: Jul. 11, 1980

Related U.S. Application Data

[63] Continuation of Ser. No. 831,534, Sep. 8, 1977.

[51] Int. Cl.[3] ..... G03C 1/78

[52] U.S. Cl. ..... 430/527; 430/631

[58] Field of Search ..... 96/87 A; 252/8.6; 260/DIG. 17, DIG. 19; 430/527, 631

[56] References Cited

U.S. PATENT DOCUMENTS

| | | | |
|---|---|---|---|
| 3,498,942 | 3/1970 | Dannals | 269/29.6 |
| 3,811,889 | 5/1974 | Endbu et al. | 96/67 |
| 3,938,999 | 2/1976 | Yoneyama et al. | 96/84 R |

*Primary Examiner*—Jack P. Brammer

*Attorney, Agent, or Firm*—James Magee, Jr.

[57] ABSTRACT

The susceptibility of polymeric film supports or polymeric coated paper to the accumulation of static electric charges can be greatly lessened by coating or swabbing such support or the uncoated side of a finished photographic film and paper with a polyfunctional anionic oligomeric surfactant or the alkali metal salt thereof, of the formula:

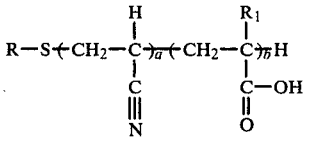

wherein R is an alkyl radical of 6–12 carbon atoms, $R_1$ is H or methyl and a+b is from 4–50.

6 Claims, No Drawings

ANTISTATIC PHOTOGRAPHIC ELEMENT

This is a continuation of application Ser. No. 831,534, filed Sept. 8, 1977.

BACKGROUND OF THE INVENTION

This invention relates to photographic film and resin coated papers having improved antistatic properties, and to a method of producing such antistatic photographic film and resin coated paper. A continuing problem during the manufacture and use of photographic film and resin coated papers is that electrical charges tend to accumulate on them. These static charges are produced as a result of friction on the film or paper from rollers and other parts of the machines through which it passes during slitting or unwinding the film, by contact with dissimilar surfaces, by handling the film, and by various other causes which are familiar to those skilled in photographic art. Electrostatic discharges can also occur as motion picture film is transported rapidly through a camera or projector. When static discharge occurs in film prior to development, it is evident after processing as irregular streaks or patterns in the film. Processed film may accumulate electrical charges in like manner which causes it to accumulate dust, lint and various particles. The type of accumulation is particularly bothersome in the case of projection of slides or motion picture film as it results in distortion of the projected image, and occasionally, in permanent scratching of the film surface.

Many methods of diminishing the tendency to accumulate electrical charges on photographic film have been suggested. U.S. Pat. Nos. 2,074,647; 2,584,337; 2,649,374; 2,725,297; 3,399,995; 3,625,695; 3,630,742 discuss antistatic treatment using resins or polymeric compounds. Compounds of this type, although effective in improving the antistatic properties of the film are usually deficient in that the antistatic layer rubs off in use, and can cause undesirable accumulations of dust or flakes in the apparatus. It is also common for such antistatic compositions to form slurries or flocculent masses during processing thereby creating difficulties.

Polymers and copolymers such as those described in U.S. Pat. No. 2,074,647 are usually quite tacky and are subject to pick-off and flocking. This is particularly unsuitable in that during unwinding of the film base, prior to emulsion coating, since areas of pick-off can produce uneven coating, and when present in sigificant quantities actually increases static discharge. Emulsion-coated rolls which are treated with this type of antistatic polymer may present an undesirable physical appearance due to pick-off.

An object of the present invention is to provide photographic polymeric film supports, photographic films and polymeric coated photographic papers which have a minimum tendency to accumulate static charges. It is a further object of the present invention to provide photographic polymer film supports, photographic films and polymeric resin coated paper having improved antistatic properties and slippage characteristics.

SUMMARY OF THE INVENTION

It has been found that the static susceptibility of photographic motion picture film coated on photographically inert polymeric film bases such as cellulose acetate, cellulose formate, cellulose propionate, cellulose butyrate, cellulose acetate-propionate, cellulose acetate butyrate, cellulose nitrate, as well as film-forming polymers such as polyvinyl-chloride, copolymers of vinylchloride-vinylacetate, copolymers of vinylchloride, vinylidene chloride, polyamides, polystyrene, polycarbonate, polyethylene terephthalate and the like can be reduced by the present invention. Photographically inert paper stocks which can be treated by the present invention are those normally used in photographic applications which have one or both sides coated with a resinous film. The susceptibility of films and paper to accumulation of electric charges can be greatly diminished and nearly totally eliminated by applying to the surface thereof an alkylsulfide terminated oligomer of the formula:

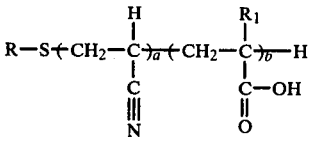

wherein R is an alkyl radical of 6–12 carbon atoms, $R_1$ is H or methyl and a+b is from 4–50. Oligomers of this type are made by Uniroyal Chemical and sold under the name of Polywet®. These antistats are applied from liquids depending upon their being an alkali salt or a free acid in amounts ranging from 0.1 to 1.0% based on the solvent volume. The alkali metal salts are applied from water while the free acids are generally applied from a polar solvent such as methanol, acetone or ethylene glycol monoethylether. It has been found to be advantageous to include a compound or composition which also improves slippage properties when cine film is treated with an antistat. A preferred type of slippage improver would be selected from silicone surfactants or an organo modified silicone copolymer composition. The thickness of the dried antistatic backing layer can range from about 0.05 to 0.5 micron in thickness, depending upon the solids concentration of the solution. The amount of total solids deposited upon the inert plastic base can be varied from 0.5 to 10 milligrams per square foot, as desired, by changing the concentration of the surfactant in the solution employed for the coating operation.

The photographic films and resin coated papers treated in accordance with the present invention have significantly lower surface reactivity and excellent adherence characteristics with respect to the antistat coating. The antistat compositions of this invention are photographically acceptable and are free of the more annoying problems which have been observed with other antistatic backwashes even when applied prior to emulsion coating. The treated films are free of tackiness and are not subject to pick-off and blocking.

The preferred alkyl sulfide terminated oligomers for use in the present invention are designated as Polywet® KX-3 and Polywet® KX-4 and Polywet® KX-5. A detailed description of these oligomers which are generally useful as emulsifiers is found in U.S. Pat. No. 3,498,942 of Dannals. The oligomers are generally used in their alkali metal salt form, preferably the potassium salt, in which form they are usually dispersed in water. These solutions may in turn be diluted with other suitable solvents and applied to the photographically inert polymeric filmbase or resin coated paper by coating, dipping, brushing or other usual ways of applying the solution or dispersion to such a polymeric support. After application of the antistatic composition, the polymeric film base is dried, leaving a final product, the surface of which is provided with a layer of the particular oligomer used.

The oligomeric surfactants which are preferred for use in the present invention are potassium salts. The Polywet® KX-3, KX-4 and KX-5 are both polymeric and polyvalent. They have molecular weights ranging from about 1200 to 1500, have long chains to which are attached substituents which provide multiple ionic charges and in addition have at one end a hydrocarbon chain. This configuration provides a hydrophilic chain of considerable length of one end of which is attached an oliophilic hydrocarbon moiety. This may account for the improved antistat properties imparted by coatings of these surfactants.

The differences between individual surfactants of the type used in the present invention is the result of the differing ratios of the monomers from which they are built and the sequence in which they occur along the chain. KX-3 has molecular weight of about 1500 and a Brookfield viscosity using a No. 3 spindle at 20 rpm of about 380. KX-4 has a molecular weight of about 1500 and a Brookfield viscosity using a No. 4 spindle at 20 rpm of about 4200. KX-5 has a molecular weight of about 1200 and a Brookfield viscosity using a No. 3 spindle at 20 rpm about 1200. These measurements were taken using a potassium salts in water at a solids content of about 45% 1 at a pH between 6.5 and 8.0.

The relative susceptibility of treated filmbase and paper to build-up of electric charges was evaluated in accordance with certain tests which measure the conductivity and the resistivity of the treated filmbase and paper. The relative susceptibility of film or paper to the build-up of static charge is related to the conductivity and resistivity of said film or paper. These characteristics may be measured by the use of a static electricity generating and measuring device such as that described in U.S. Pat. No. 2,584,337. Surface resistivity as defined in U.S. Pat. No. 2,649,374 is an indication of the electrical resistance of a film sample. It is determined by measuring the resistance in megohms between two electrodes. These values are influenced by the width and spacing between the electrodes but these considerations may be disregarded since these factors are kept constant during comparison tests.

Another indication of susceptibility of a treated filmbase or coated paper may be had by a somewhat subjective test. The film is simply rubbed a pre-determined number of times with a fabric such as nylon in a controlled environment. This charge test simulates handling of the film during loading of the camera, or rubbing or guiding the film while splicing or loading the film into a processing unit for the development or even the handling of film during projection. A simple manifestation of this test is to hold the rubbed filmbase near suspended cotton threads and observe the degree of attraction the base has for the thread. Effective antistat treatments will result in a film which despite rubbing, will not attract threads to any significant extent. When the antistat treatment is ineffective or no antistat coating has been applied, rubbing will produce sufficient charge to attract the threads toward the base. This test also gives indication of the film or papers likelihood to become charged and attract lint, dust and other debris.

It has also been noted that the antistat treatment of the present invention applied to the underside of a film base as a back-wash does not flake or erode off onto the camera rollers or pressure plates. This problem has been known to occur in earlier antistat applications. It also avoids the undesirable accumulation of dust or flakes in the camera itself. In certain instances, particularly in which polymers have been used to form the antistat coating, there is a possibility of a scumming residue forming in the processing solutions which may adhere to the film. Slides or movie film to which such residue attaches itself will be esthetically unattractive and give poor images when projected. The antistats of the present invention have been found to be compatible with the processing solutions and do not form a sludge or scum.

The strong adherence of the antistat of the present invention to the underside of film yet to be coated with emulsion is particularly advantageous in that it avoids pick-off of the antistat or other coating during the unwinding preceding the emulsion coating. The pick-off can result in areas of the upper side of the base which are not coatable and which show up as spots or other visual defects upon imaging and processing the finished film. The antistat of the present invention are also compatible with lubricant compounds such as silicone surfactants or organo modified silicone lubricants. This permits the production of a film which not only has improved antistat characteristics, but desirable slippage properties which improve the ease of advance in cameras and other hardware.

The following examples are given by way of exemplification and not by limitation. It will be obvious to workers skilled in the art that many modifications may be made therein without departing from the scope or spirit of the present invention and claims.

EXAMPLE 1

Antistat coating solvent solutions were prepared comprising 40 parts methyl Cellosolve®, 40 parts ethanol, 15 parts acetone, and 5 parts water containing respectively 0.05, 0.1, 0.2, 0.3 and 0.5 parts of Polywet® KX-5 which had been first dissolved in the water and then diluted to volume with other solvents. The five solutions were filtered and coated on cine acetate filmbase via conventional bead application technique. Another coating was prepared which had been treated in a similar manner by a similar solvent composition but without the antistat compound addition. After drying, the resistivity of the coated side of the films was obtained as is noted

| | Surface Resistivity |
|---|---|
| 1. Control-no antistat | Greater than $10^4$ megohms |
| 2. 0.05% antistat | $1.3 \times 10^3$ megohms |
| 3. 0.10% antistat | $2.6 \times 10^2$ megohms |
| 4. 0.20% antistat | $5.0 \times 10$ megohms |
| 5. 0.30% antistat | $5.0 \times 10$ megohms |
| 6. 0.50% antistat | $3.8 \times 10$ megohms |
| | (Samples conditioned 24 hrs. at 21° C. 50% RH) |

Resistivity readings of $10^2$ are recognized as providing effective antistat protection, $10^3$ readings generally are marginal while $10^4$ and greater readings result in unacceptable cine film performance. The addition of 0.1% silicone surfactant or an organo-modified silicone copolymer composition to the antistat composition results in at least 50% increase in slipperiness with no impairment to the antistat properties. In certain types of cine film, it is an advantage to provide enhanced slippage characteristics to the film to promote ease of advance through the camera.

In another test, sections of the films prepared above were slit to 35 mm width and in a 55% RH environment were rubbed similarly with a cotton cloth. Each film was passed near a suspended cotton string. The attraction of the string to the film was readily noted with the Control strip. However only slight to no attraction of the string was noted with the samples coated with the antistat composition. This test indicates from practical experience, that effective antistat properties have been provided to the film using the composition of the invention.

EXAMPLE 2

Antistat solutions were prepared comprising deionized water and 0.25, 0.6, 0.75, and 1.0% parts Polywet® KX-5 by volume. The solutions were filtered and applied to polyethylene coated photographic paper base by means of a conventional metering technique. An uncoated section of resin coated photographic paper base was retained as a control. The resistivity of the treated side of the resin coated paper was obtained and is noted as is the coating appearance of the antistat coating:

| | Surface Resistivity | |
|---|---|---|
| 1. Control-no treatment | Greater than $10^4$ megohms | |
| 2. 0.25% antistat | $40 \times 10^4$ megohms | repellent appear. |
| 3. 0.60% antistat | $6.0 \times 10^2$ megohms | Some repellent appear |
| 4. 0.75% antistat | $4.0 \times 10^2$ megohms | acceptable coating |
| 5. 1.00% antistat | $4.0 \times 10^2$ megohms | acceptable appear. |

(Samples conditioned 24 hours at 21° C., 50% RH)

Practical experience with the static behavior of resin coated paper base, particularly in slitting operation, indicates that resistivity readings of $10^2$ provide effective antistat protection.

EXAMPLE 3

Antistat solutions were prepared comprising 40 parts methyl Cellosolve®, 40 parts ethanol, 15 parts acetone, and 5 parts water containing 0.22 parts of Polywet® KX-3 which had been first dissolved in the water and then diluted to volume with the other solvents. The solutions were filtered and coated on cine acetate filmbase via conventional bead application technique. Another coating was prepared which had been treated in a similar manner by a similar solvent composition—but without the antistat compound addition. After drying, the resistivity of the coated side of the films was obtained as is noted below:

| | Surface Resistivity |
|---|---|
| Control-no antistat | Greater than $10^4$ megohms |
| 0.22% KX-3 antistat | $1.4 \times 10^2$ |

(Samples conditioned 24 hours at 21° C., 50% RH)

Resistivity readings of $10^2$ are recognized as providing effective antistat protection, $10^3$ readings generally are marginal while $10^4$ readings result in unacceptable cine film performance. The addition of 0.1% silicone surfactant or an organo-modified silicone copolymer composition to the solvent composition results in at least 50% increase in slipperiness and with no impairment of the antistat properties. In certain types of cine film, it is an advantage to provide slippage characteristics to the film to promote ease of advance through the camera.

In another test, sections of the films prepared above were slit to 35 mm width and in a 55% RH environment were rubbed similarly with a cotton cloth. Each film was passed near a suspended cotton string. The attraction of the string to the film was readily noted with the control strip. However, only slight to no attraction of the string was noted with samples coated with the antistat composition. This test indicates from practical experience that effective antistat properties have been provided to the film using the composition of the invention.

EXAMPLE 4

Antistat solutions were prepared comprising deionized water and 0.46 and 0.56 parts Polywet® KX-3 by volume. The solutions were filtered and applied to polyethylene coated photographic paper base via a conventional metering technique. An uncoated section of resin coated photographic paper base was retained as a control. The resistivity of the treated side of the resin coated paper was obtained and is noted as is the coating appearance of the antistat coating:

| | Surface Resistivity |
|---|---|
| 1. Control-no treatment | Greater than $10^4$ megohms |
| 2. 0.46% KX-3 antistat | $3 \times 10^2$ megohms-but a non-uniform coating |
| 3. 0.56% KX-3 antistat | $1.3 \times 10$ megohms-uniform coating |

The static behaviour of resin coated paper base, particularly in slitting operation, is such that resistivity readings of $10^2$ are recognized as showing effective antistat protection. Coating aids, particularly those of the anionic or nonionic type common to those used in the art can be added to the antistat rinse solution to aid in uniformity of the coating treatment. This may permit the use of a lower concentration of the antistat.

EXAMPLE 5

Antistat solutions were prepared comprising 23.5 parts methanol, 76.5 parts acetone and 0.15 parts Polywet® KX-4 which was first dissolved in the methanol and then diluted to volume with the acetone. The solutions were filtered and coated on cellulose acetate film such as tinted base normally used for color print film via conventional bead application technique. After drying the resistivity of the coated side of the film was $10^2$ megohms which provides effective antistat protection. These antistat properties are particularly necessary during the handling of the film during the coating and packaging of the sensitized product as well as during the performance of the film in the camera cartridge. Lower concentrations in range of 0.10 parts of KX-4 provided high resistivity values while concentrations above 0.2 parts cause a solution haze which can result in a slight haze on the coated film.

EXAMPLE 6

Antistat solutions were prepared comprising 83.5 parts methanol, 16.5 parts acetone and 0.92 parts Polywet® KX-4 which was first dissolved in the methanol and then diluted to volume with the acetone. The solutions were filtered and coated on photographic grade polyester base via conventional bead application technique. After drying, the resistivity of the coated side of the polyester film was obtained and is noted below:

| | Surface Resistivity |
|---|---|
| 1. Control-no antistat | $100 \times 10^4$ (off scale) |
| 2. 0.1% KX-4 Antistat | $3.0 \times 10^2$ |

(Samples conditioned 24 hours at 21° C., 50% RH)

The lower resistivity of the KX-4 treated base from practical experience provides antistat protection during the manufacturing and finishing (slitting and packaging) of Aerial film product. Also static problems during Aerial film camera operation are minimized.

EXAMPLE 7

Aqueous coating solutions were prepared with 0.138, 0.23, 0.34, 0.46, 0.58 and 0.69 parts Polywet® KX-4 solids by volume. The solutions were filtered and applied to resin (polyethylene) coated photographic paper base via a conventional metering coating technique. An uncoated section of resin coated photographic paper base was retained as a Control. Inspection of the coating appearance showed non-uniformity with the 0.138–0.23 part concentration. The 0.34 parts was marginal for coating appearance. Concentrations of 0.46 parts and higher produced satisfactory coatings. Resistivity readings of the treated side of these satisfactory coatings were all in $10^2$ megohms range. The untreated paper base had high resistivity in the greater than $10^4$ megohms range.

| | Surface Resistivity |
|---|---|
| 1. 0.138% KX-4 Antistat | $8 \times 10^2$ megohms |
| 2. 0.23% KX-4 Antistat | $5 \times 10^2$ megohms |
| 3. 0.34% KX-4 Antistat | $3 \times 10^2$ megohms |
| 4. 0.46% KX-4 Antistat | $3 \times 10^2$ megohms |
| 5. 0.57% KX-4 Antistat | $1.5 \times 10^2$ megohms |
| 6. 0.69% KX-4 Antistat | $1.5 \times 10^2$ megohms |

(Samples conditioned 24 hours at 21° C., 50% RH)

Additional trials with the KX-4 concentration reduced to 0.23 parts could be coated satisfactory by adding coating aids such as Union Carbide's Tergitol® 4—Atlas Brij® 30 combinations or Saponin, or other compatible coating aids normally used by those in the art. Resistivity of these coatings showed resistivity in the $10^2$ megohm range—very similar to the resistivity values obtained with the 0.23 parts KX-4 concentration which coated with non-uniformity when used by itself. In other words, the KX-4 still functioned as an antistat but at lower concentrations could only provide a more uniform coating when used in combination with a compatible coating aid.

It is to be understood that the invention described above may be modified in various ways without departing from the spirit thereof or the scope of the invention as claimed.

What is claimed is:

1. A light-sensitive silver halide emulsion containing photographic element comprising a support susceptible to the accumulation electric charges thereon which is provided on at least one surface thereof with an antistatically effective amount of a polyfunctional anionic oligomeric surfactant of the formula:

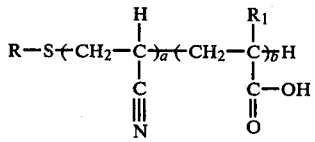

wherein R is an alkyl of 6 to 12 carbon atoms, $R_1$ is H or methyl and a+b is from 4 to 50 and a/a+b is from 0 to 0.6.

2. A photographic element as set forth in claim 1 wherein the surfactant is present in the form of its alkali metal salt.

3. A photographic element as set forth in claim 1 wherein the surfactant is present in the form of its potassium salt.

4. A photographic element as set forth in claim 1 wherein the support element is selected from the group consisting of polymeric photographic film base and resin coated paper.

5. A photographic element as set forth in claim 1 wherein the surfactant is present in an amount of 0.5 to 10 milligrams per square foot and when dried forms a layer from 0.05 to 0.5 microns thick.

6. A photographic element as set forth in claim 1 wherein the light-sensitive portion comprises one or more color sensitive layers.

* * * * *